United States Patent [19]

Barber

[11] Patent Number: 5,005,761

[45] Date of Patent: Apr. 9, 1991

[54] MULTIPLE ACCESS NEWSPAPER RECEPTACLE

[76] Inventor: James E. Barber, 319 E. Elm St., Wauseon, Ohio 43567

[21] Appl. No.: 55,006

[22] Filed: May 28, 1987

[51] Int. Cl.[5] ..... B65D 91/00

[52] U.S. Cl. ..... 232/1 C; 232/43.4

[58] Field of Search ..... 232/1 C, 43.4, 17

[56] References Cited

U.S. PATENT DOCUMENTS 3,888,409 6/1975 Bolduc ..... 232/1 C 4,660,757 4/1987 Hicks ..... 232/1 C

*Primary Examiner*—Robert W. Gibson, Jr.

*Attorney, Agent, or Firm*—George R. Royer

[57] ABSTRACT

The subject invention is a multiple access newspaper receptacle, which comprises, in general, a longitudinally extending housing with a corresponding internally disposed hollow chamber, having a dual entry access to said hollow chamber. First, there is a hinged door for entrance from the front of the box, with a second access door on back, or front of said newspaper tubular member. Each door is hinged to the tubular member and each door has integrally constructed therein a shaft member the ends of which are pivotally mounted into the tubular member, with one door being adapted to pivot from the bottom inside of the housing and the other door being adapted to be pivoted from the upper inside of the housing.

1 Claim, 1 Drawing Sheet

MULTIPLE ACCESS NEWSPAPER RECEPTACLE

DISCUSSION OF PRIOR ART AND BACKGROUND OF INVENTION

The primary application of the subject invention is to newspaper receptacles. Other potential applications include parcel drop boxes, wherein the user must extract the contents after a deposit therein of specified types of articles. The invention additionally has other applications to containers used in business or other purposes of intermediate or temporary storage of items intended for later usage. In this respect, since the primary application of this invention is to the manufacture and construction of newspaper receptacles used primarily in rural or suburban areas, the following discussion will be directed mainly to this type of container, with the understanding that the background will be substantially similar for the other types of devices and that the invention has such wider applicability.

The construction and usage of newspaper receptacles of the type used primarily in rural or suburban areas differs significantly from those used in older urban areas. In this respect, in urban areas of moderate or large-sized cities, newspaper receptacles are usually appended directly to a building, and as such they are generally offset from the road, being on the building they are generally distal from the roadway, some distance, on which the dwelling is located. In comparison, newspaper receptacles in rural areas and many suburban areas are usually affixed above the ground on a vertical stanchion positioned immediately adjacent the road. In this respect, the newspaper receptacle door, or entranceway, is almost universally faced towards the roadway. The entrance doorway is usually emplaced extremely close to the edge of the roadway travelled by the delivery vehicle to facilitate placing of newspapers inside. Frequently, the adjacent roadway is a heavily traversed thoroughfare, with vehicles passing at at moderate to high speeds a relatively few feet from the receptacle entrance door. One can readily ascertain the relative danger to the patron by the proximity of the mailbox to the roadway traffic, in view of the fact that the user must step close to the roadway traffic in order to extract the newspaper from the receptacle. The potential for vehicular-pedestrian mishaps is substantial under such circumstances, and the threat of serious injury is a very real danger. The danger lies in the fact that the patron, or any family member who seeks to obtain the newspaper from the receptacle must step in front of the box to open the doorway, and pull the paper out accordingly. Such a procedure normally entails the need to stand in front of the receptacle doorway or close thereto and this may require, in many instances, being too close to the doorway. This aspect clearly presents a potential danger by reason of the close proximity to the roadway and the traffic thereon. Yet another problem involved with the use of such newspaper boxes is the type of doorway that is employed is frequently constructed in a manner that does not lead to maximum durability. This invention is also conceived to the end of improving doorway durability.

This invention is conceived as a means to overcome the foregoing problems and devise a receptacle which avoids or alleviates, to a substantial degree, the potential for highway accidents involving persons who are extracting newspapers from a receptacle and provide improved doorway durability. The following objects of the subject invention are directed accordingly.

OBJECTS

It is an object of the subject invention to provide an improved newspaper or parcel receptacle;

Another object of the subject invention is to provide a newspaper receptacle which is safe to use of the type used in rural and suburban areas;

Still another object of the subject invention is to provide a receptacle which is safe to use when placing or removing the contents therefrom;

A further object of the subject invention is to provide an improved paracel receptacle;

Still another object of the subject invention is to provide an improved object receptacle of the type used close to highways;

Yet another object of the subject invention is to provide an improved receptacle in which two doors are employed;

Another object of the subject invention is to provide a multiple or variable access newspaper receptacle;

Yet another object of the subject invention is to provide an improved newspaper receptacle;

An object of the subject invention is to provide an receptacle which alleviates highway safety problems;

Still another object of the subject invention is to provide an improved door mechanism and structure for a newspaper delivery receptacle;

Yet another object of the subject invention is to provide an improved doorway for newspaper or mail box deliver device.

Other and further objects of the subject invention will become apparent from a reading of the following description taken in conjunction with the drawings.

DRAWINGS

In the drawings, FIG. 1 is a side elevational view of the subject invention shown partially in section;

FIG. 2 end elevational view of the subject invention;

FIG. 3 is a front elevational view of the doorway structure incorporating features of the subject invention;

FIG. 4 a perspective view of the attachment mechanism used in attachment of the pivot post to the housing member;

FIG. 5 is a side elevational view of the door device;

FIG. 6 elevational view of the door spring attachment mechanism.

DESCRIPTION OF GENERAL EMBODIMENT

The subject invention is directed to a newspaper receptacle or a similar parcel receptor, which is adapted to have means to avoid the necessity of having the user stand in front of the receptacle and open the door thereof, near a roadway, in order to place therein or remove newspaper or other contents. In its most general form, the subject invention incorporates features of a secondary entranceway or doorway by which the user of the receptacle or other receptor can extract the contents, or emplace newspapers, etc., therein, without the need of standing in front of the doorway by the road edge. Each door is equipped with a shaft integrally constructed therein with perpendicular web extensions extend over the surface of the door in perpendicular fashion to the shaft to add supportive strength to the door. Said second door may be equipped with a retaining mechanism of variant form, which prevents such second doorway from being pushed open from the inside, thereby preventing any materials that are emplaced in the receptacle through the primary door from causing the secondary door to open from the inside front of the receptacle and open the door thereof, near a roadway, in order to place therein or remove newspapers or other contents. In its most general form, the subject invention incorporates features of a secondary entranceway or doorway by which the user of the receptacle or other receptor can extract the contents, or emplace newspapers, etc. therein, without the need of standing in front of the doorway by the road edge. Each door is equipped with a shaft integrally built therein and where web extensions extend over the surface of the door in perpendicular fashion to the shaft. Said second door may be equipped with a retaining mechanism of variant forms, which prevents such second doorway from being pushed open from the inside, thereby preventing any materials that are emplaced in the receptacle through the primary door from causing the secondary door to open from the inside.

DESCRIPTION OF PREFERRED EMBODIMENT

Figure 1:
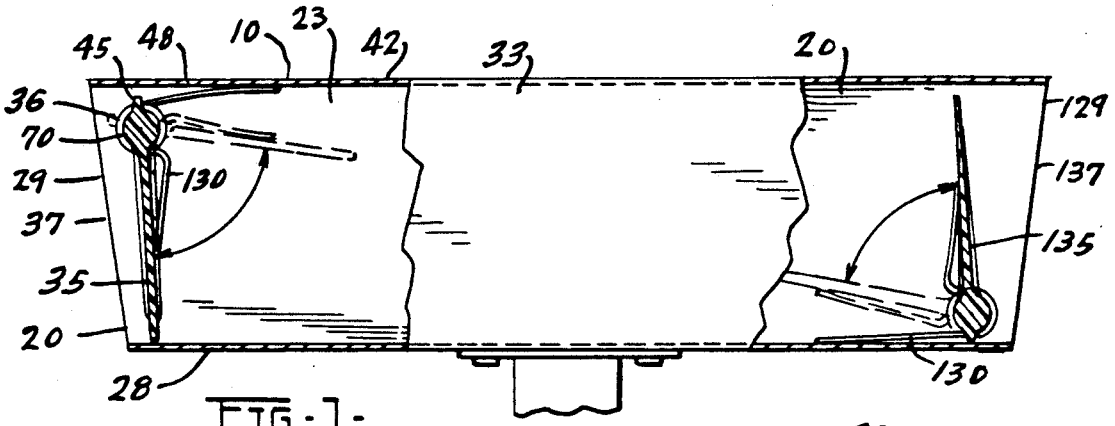
Figure 2:
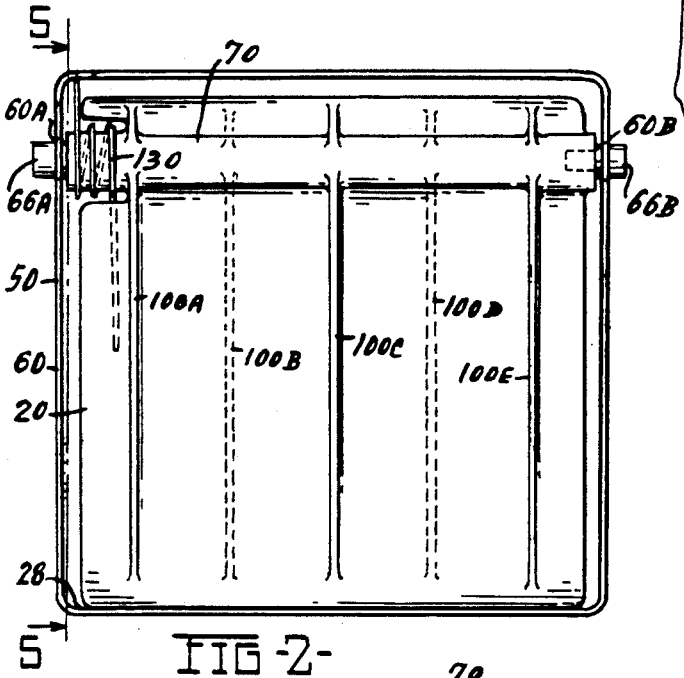
Figure 5:
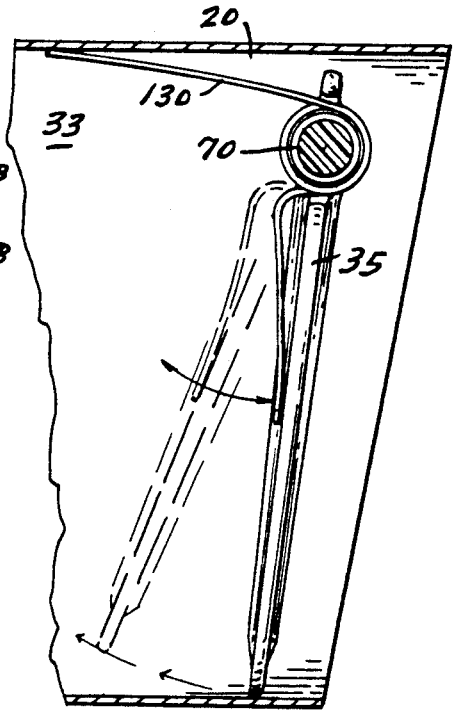

Referring now to the drawings in which a preferred embodiment of the subject invention is shown, and particularly to FIGS. 1 and 2. In describing the subject invention, it is to be noted that the word "frontal" will be used in reference to those portions of the receptacle which are oriented towards or facing towards the roadway, while the words "rear" or "posterior" will be used in reference to those areas of the receptacle which are facing generally away from the roadway. Moreover, it is to be stressed that in describing the subject invention, the following description will be directed to a limited number of particular embodiments, however, such description should not be considered to limit the scope of the invention and the following claims.

In FIG. 1, the receptacle 10, as shown, possesses some of the features of the conventionally structured newspaper receptacle, as seen on rural or suburban delivery routes. In particular, receptacle 10 comprises a longitudinally extending housing member 20, the interior of which is hollow in order to receive newspaper or other contents therein. In general, the interior chamber 23 of the receptacle housing 20 is of a longitudinal disposition usually conforming to the exterior configuration of the housing 20, although this aspect is not critical to the utility of the housing.

The interior chamber of the housing 20 has a horizontally disposed floor 28, with a solid top 42 to cover the inside chamber to protect same from adverse climatology. Disposed on the frontal end 29 of the housing 20 is a pivotable door 35, which is structured to conform to the shape of the front entranceway 37. Door 35 is pivotally mounted on its upper portion 38 to housing 20, as shown in FIGS. 1 and 2.

Disposed on the rear position of the receptacle shown in FIG. 1 is a rearwardly facing doorway 135, pivotally mounted to the rear of housing 20, as shown in FIG. 1. Such rearwardly facing doorway 135 is constructed with the same hinging features as the frontal doorway 35, with neither being capable of being moved outwardly from the housing 20.

As can be seen from the drawings, lateral sidewalls 50A and 50B have circular openings therein 60A and 60B adapted to hold in a pivotal relationship, the respective ends 66A and 66B of a pivotal bar member 70.

Figure 3:
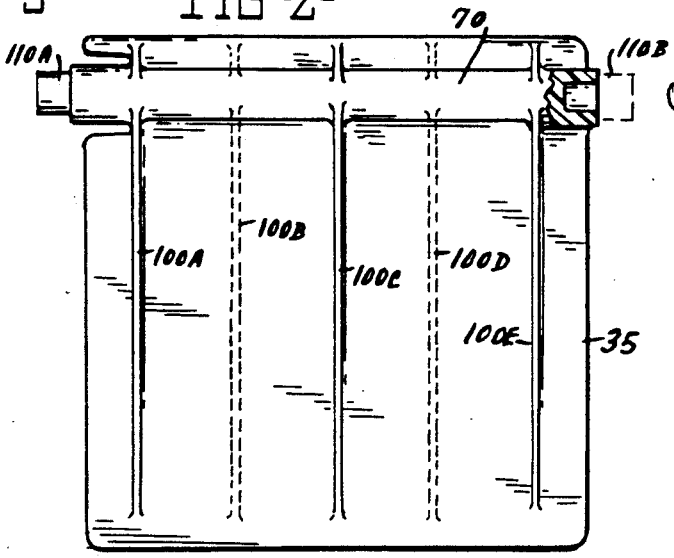
Figure 4:
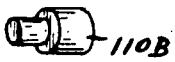
Figure 6:
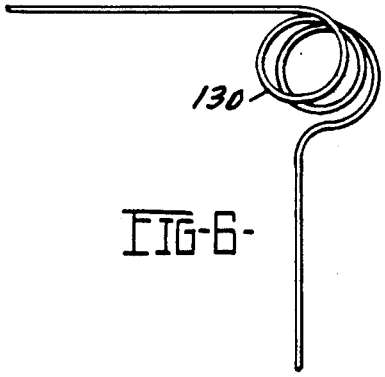

The generally rectangularly-shaped doorway 35 has a pivotal bar member 70 integrally constructed therein as seen in FIGS. 2 and 3. In particular, the pivotal bar member 70 is formed as an integral part of the doorway 35 as formed in the upper part of said doorway 35. The ends 66A and 66B of said integrally formed doorway 35 fit rotatably into the openings 60A and 60B, as seen.

As seen in FIGS. 2 and 3 extending perpendicularly from said integral pivot bar 20 over the outer surface of said doorway 35 are five web-like extensions 100A, 100B, 100C, 100D and 100E, which project outwardly over the rear outer surface of said doorway. These web-like extensions 100A . . . 100E function to provide rigidity and strength for the doorway 35. It is to be noted that the precise number of such webs is not critical to the subject invention. As seen, in addition, such webs extend above and below the pivotal bar member 70.

In the embodiment shown in FIGS. 2 and 3, the ends 66A and 66B of pivot bar member 70 are equipped with inserible cylindrical plug 110A and 110B respectively, which plugs are inserted into the end openings 120A and 120B in the pivot bar member, as shown. Such plug extensions of the pivot bar member 70 serve as the extended ends of such bar member 70, as shown. Also, as shown in the drawings, the pivot end 66A, bar member 70 is spring biased by coil spring 130, as shown.

The rear doorway 135 is equipped and structured precisely as the front doorway but, as shown, from the bottom instead of from the top of the housing.

I claim:

1. A newspaper receptacle having opposing ends with an individual pivotable doorway on each end, such receptacle having a doorway hinge structure for each said individual doorway comprising:

(a) a base planar member having a frontal face and rear face and having an upper part and a lower part said base planar member comprising the basic pivotable doorway structure;

(b) a longitudinally extending pivot bar member with end portions integrally formed as part of said planar member on the upper part thereof and extending transversely over said door width on the upper part thereof; said bar member being rounded on each respective end portion;

(c) a plurality of web members extending over the frontal face of said doorway, said web members extending over the frontal face of said doorway, said web members being perpendicular to said bar member and extending from said bar member in a vertically downward direction as an integral extension of said bar member.

* * * * *